US006471265B1

(12) United States Patent
Scott, Sr.

(10) Patent No.: US 6,471,265 B1
(45) Date of Patent: Oct. 29, 2002

(54) DOOR SECURITY STRIKER FASTENING PLATE AND METHOD

(76) Inventor: Nathan Scott, Sr., 828 Kinwest Pkwy. #124, Irving, TX (US) 75063

( * ) Notice: Subject to any disclaimer, the term of this patent is extended or adjusted under 35 U.S.C. 154(b) by 23 days.

(21) Appl. No.: 09/715,899

(22) Filed: Jun. 8, 2000

(51) Int. Cl.[7] ..... E05B 15/02
(52) U.S. Cl. ..... 292/341.15; 292/340
(58) Field of Search ..... 292/341.15, 340

(56) References Cited

U.S. PATENT DOCUMENTS 1,318,382 A * 10/1919 Herby ..... 292/341.15 X
1,919,739 A * 7/1933 Minzenmayer .... 292/341.15 X
2,904,367 A * 9/1959 Bennett et al. ..... 292/341.15
5,613,718 A * 3/1997 Lin ..... 292/346
6,022,056 A * 2/2000 Cope et al. ..... 292/144

* cited by examiner

*Primary Examiner*—Teri Pham Luu

(57) ABSTRACT

The disclosed improved striker fastening plate and method consists of a striker fastening plate, a recoiling guided stop plate and a biasing means, which functions as a method for resisting kick-in and pry-in attempts to, without authorization, enter into a property. This is accomplished when the force from an entry attempt activates the recoiling guided stop plate. As the recoiling guided stop plate moves away from the source of the force, the biasing means is activated to absorb the shock or movement caused by the force, stores it as energy and releases it back toward it's source, returning the recoiling stop plate back to it's original position, thus maintaining a securely locked door or portal.

4 Claims, 18 Drawing Sheets

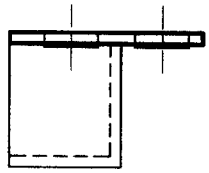
FIG. 12B
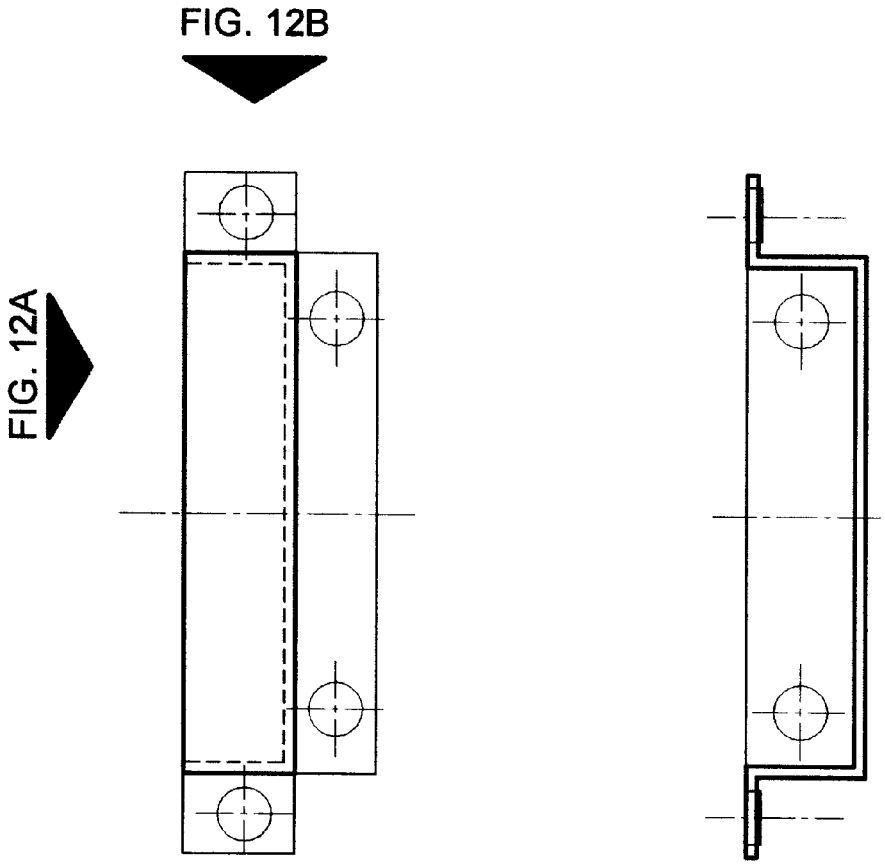
FIG. 12
FIG. 12A

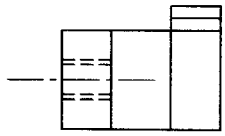
FIG. 13B
FIG. 13B
FIG. 13A
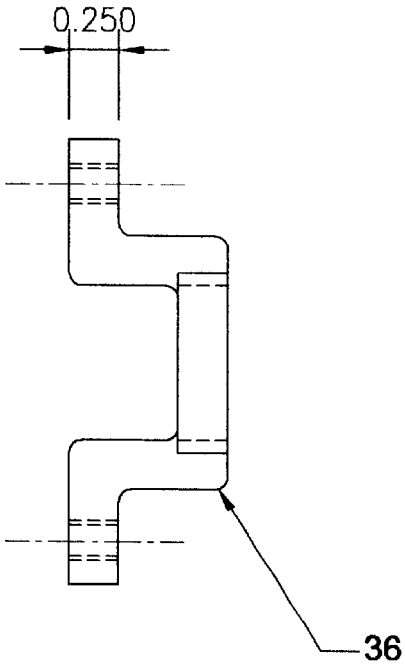
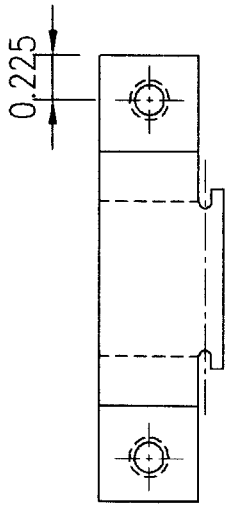
FIG. 13
FIG. 13A

DOOR SECURITY STRIKER FASTENING PLATE AND METHOD

TECHNICAL FIELD

This invention relates in general to security devices and more particularly, to an improved door security device and method for preventing unauthorized intrusion. The present invention is particularly designed to deter "kick-in" and "pry-in" burglaries by both enhancing and safeguarding the structural integrity of the door and its door jamb by reduction of the shock and impact imparted to the doorjamb and latch mechanism, and its striker fastening plate and by providing a more reliable door/door jamb connection.

BACKGROUND OF THE INVENTION

Conventionally, in the past, it was the practice to employ a variety of dead bolts on doors, which extend between the swinging door and the door jamb. The dead bolt extends between the door and jamb in such a manner as to provide a rigid attachment or fastening so as to prevent passage of unauthorized persons through the door or portal. Usually, the mechanism for the dead bolt or spring latch is on the inside of the door, and when actuated, causes the sliding bolt or spring latch to extend into a receptacle provided in the door jamb. Generally, the receptacle is in alignment with a central opening in a striker fastening plate so the moveable latch of the key lock mechanism will strike the plate and due to its spring bias, extend into the receptacle as well. Therefore, whether a movable latch of a lock mechanism or a sliding dead bolt is used, a striker fastening plate is part of a conventional installation on the door jamb itself. Generally, fasteners such as screws retain the striker fastening plate to a wooden door jamb and the striker fastening plate adds strength to the area where the latch or bolt secures to the jamb.

Problems and difficulties have been encountered when using such a conventional bolting system, which stem largely from the fact that wooden jambs may be readily kicked or broken so that the desired effect of a dead bolt or locking mechanism is avoided. An intruder may readily forcibly impact the door where the bolt or latch is located and the bolt or latch itself will be driven through the relatively weakened wood of the door jamb at that precise location. Obviously, repair is extensive, costly, and as well time-consuming. Additionally, the express purpose and reason for locking the door is avoided since access can be made by destroying the door jamb through kicking or otherwise hammering at the bolt location. Therefore, a long-standing need has existed to provide a novel safety striker fastening plate which will strengthen the door jamb and at the same time permit removable disposition of a dead bolt or the like into the conventional receptacle. Such a device must be easy to install and convenient to use as well as well as adaptable to a variety of different width doorjambs and doorjamb designs.

SUMMARY OF THE INVENTION

The present invention is directed to an improvement in door security devices and the method for preventing unauthorized intrusion through a door or other portal, which while providing a releasable door/door jamb connection thereby significantly reduces the likelihood of a "kick-in" or "pry-in" entry.

The device of the present invention, which may be generally described as an improved door striker fastening plate design, comprises a heavy-duty striker fastening plate that is securable to a standard door jamb by a plurality of hardened screws in a more or less standard installation by use of a slightly larger required cut-out recess in the flat door jamb surface for fitting about a standard dead bolt or standard spring latch lock set conventionally mounted on the door.

Generally, in all embodiments of the present invention, the invention comprises a modification to the conventional door striker fastening plate which causes the stop area for the door latch in the cut-out area in the opening of the fastening plate to be modified in such a manner as to cause it to move along a path away from force applied in an unauthorized entry attempt and return to its original position, thereby causing it to move in a direction from which force is applied when forced entry is attempted through the portal by kicking or prying efforts and thereby prevent the release of the door latch and resultant forced entry through the portal.

In the present invention, in a door jamb construction having a jamb shoulder and flat jamb surface an improvement is made to the conventional striker fastening plate assembly to cause the addition of a recoiling guided stop plate constrained to move along a path away from applied force in an unauthorized entry attempt and return to its original position by a biasing means to remain in a fixed position in order to restrain the door latching member in order to cause the door to remain in a closed position.

The use of this improvement makes forced entry by kicking or prying difficult because the recoiling guided stop plate moves away from the direction of the kick or prying efforts and stores the energy of the kick or other effort and redirects it back in the opposite direction to the kick or other break in efforts, thereby absorbing and reducing the pressure exerted against the securing screws and against the door jamb. The use of the present invention will reduce or prevent the breaking of the striker fastening plate or door latch and the breaking of the doorjamb and thus prevent unauthorized entry through the door or portal.

In one preferred embodiment of the invention, the recoiling guided stop plate is restrained by stiff springs, to enable the storage of the energy of the kick or other forced entry attempts and moves away to prevent the release of the door latch and thus cause the door to remain in a closed position even after repeated efforts to force it open.

Therefore, it is among the primary objects of the present invention to provide an improved novel door safety striker fastening plate which will accommodate installing on a variety of sizes and widths of door jambs and which when installed will prevent the forcible entry into a room by kicking and breaking the door jamb at the striker fastening plate.

Another object of the present invention is to provide a novel door safety striker fastening plate that is easy to install and may be readily installed without the use of special knowledge techniques or special equipment.

BRIEF DESCRIPTION OF THE DRAWINGS

For a more complete understanding of the present invention and for further advantages thereof, reference is made to the following descriptions of the preferred embodiments taken in conjunction with the accompanying drawings, in which:

Closely related figures have the same number but different alphabetic suffixes.

FIG. 12 shows a double coil spring containing back-up plate.

FIG. 13 shows a double coil spring containing version of the notched recoiling guided stop plate.

REFERENCE NUMERALS IN DRAWINGS

Figure 1:
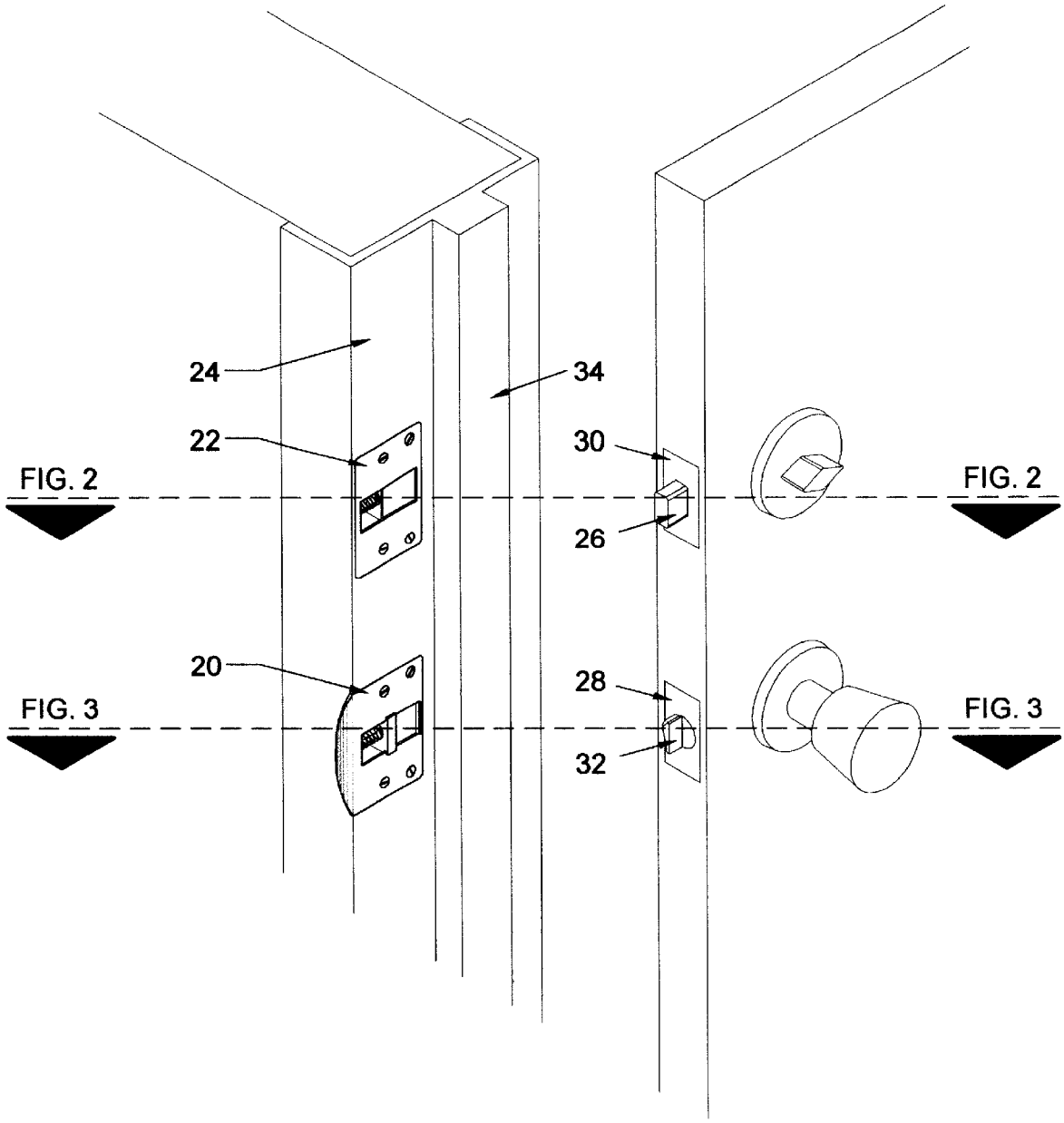
FIG. 1 shows a perspective view of a cut away portion of a doorjamb and a door, which illustrates the application of the present invention to the flat jamb surface and shows the door jamb shoulder which stops the door when it is closed.
Figure 2:
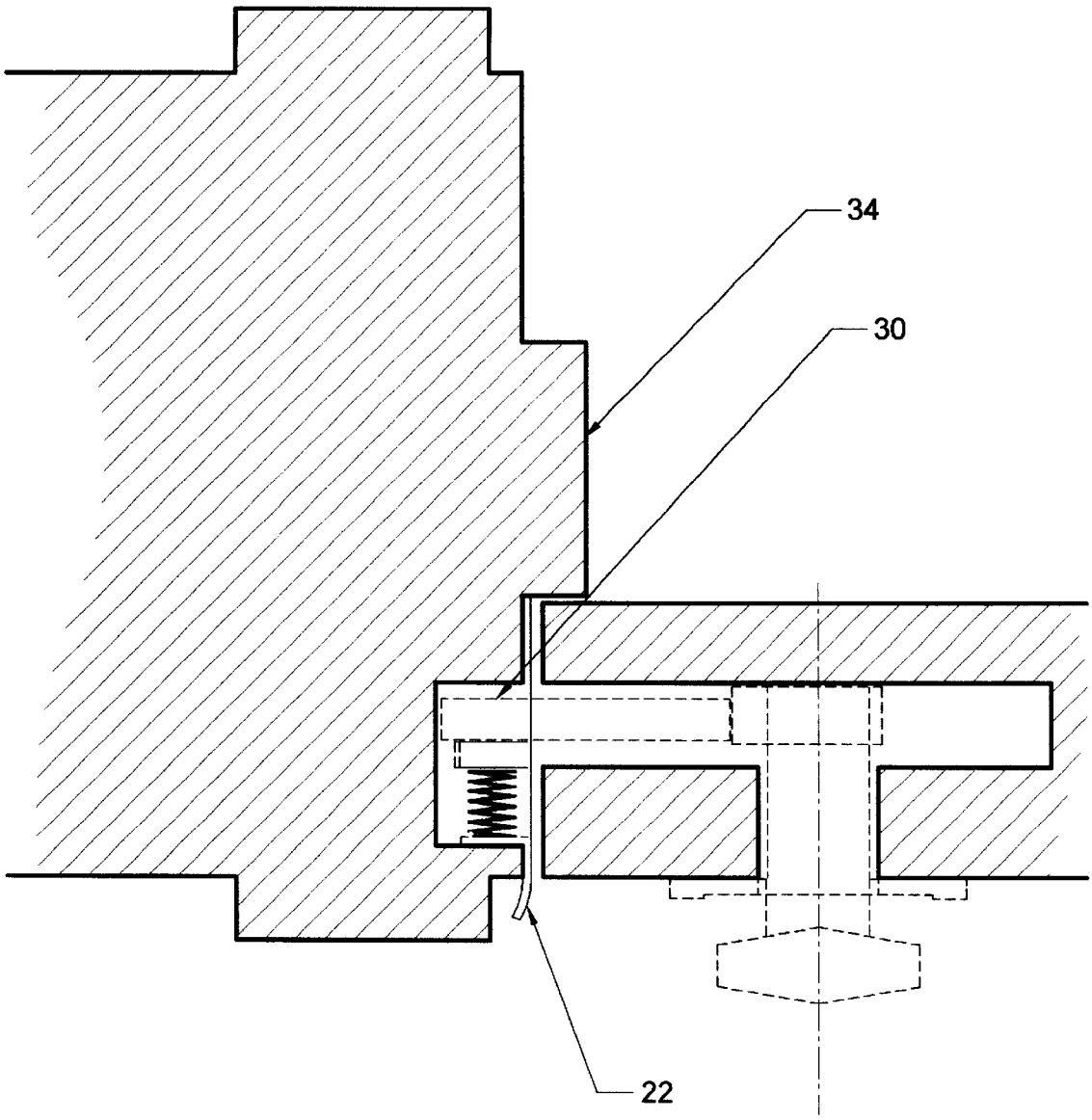
FIG. 2 is a section view across FIG. 1, along section line 2—2 in the direction shown in the arrows and illustrates the application of the present invention to a dead bolt locking system.
Figure 3:
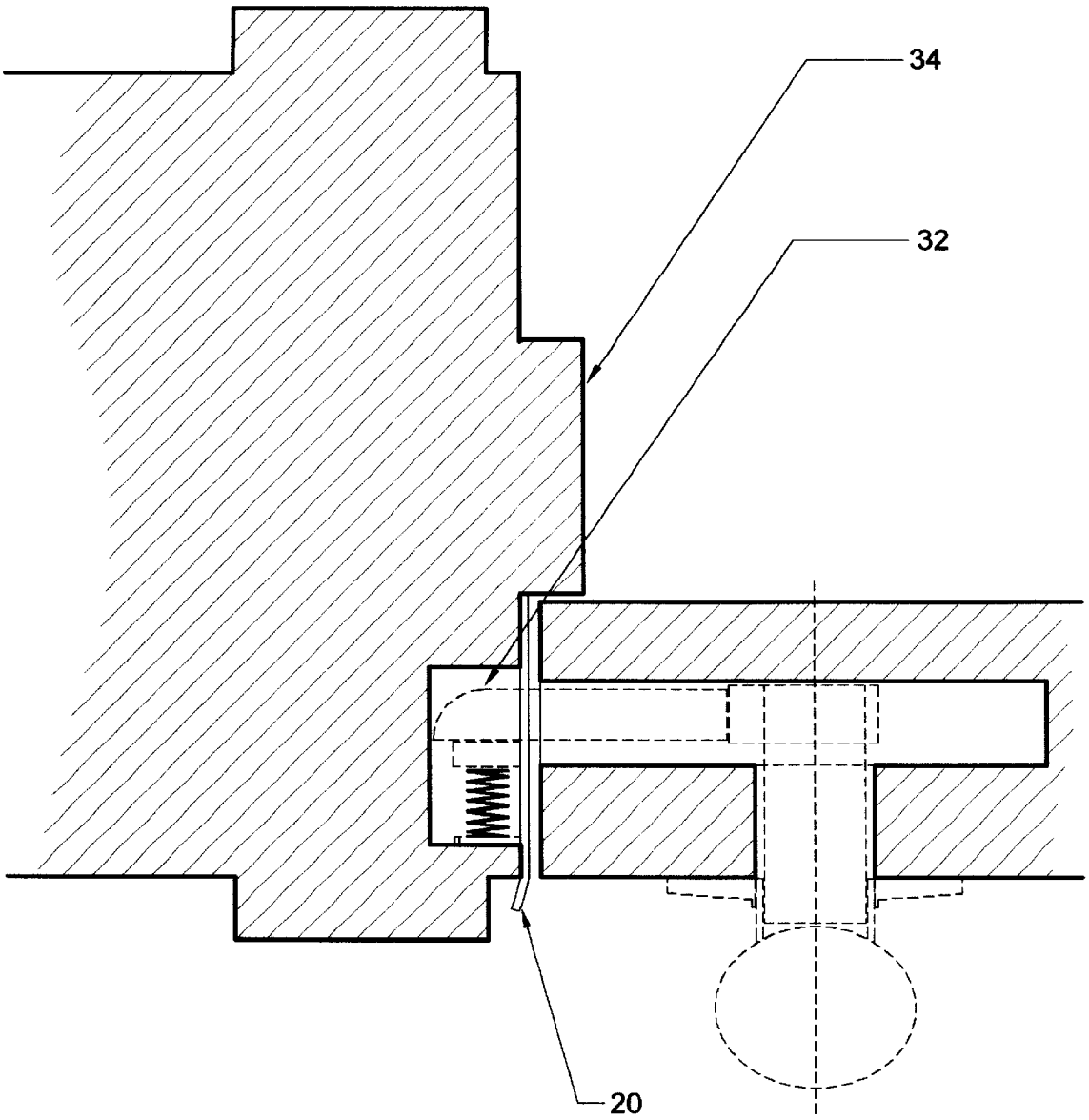
FIG. 3 is a section view across FIG. 1, along section line 3—3 in the direction shown in the arrows and illustrates the application of the present invention to a spring latch locking system.

20. Improved striker fastening plate for spring door latch
22. Improved striker fastening plate for dead bolt door latch
24. Flat doorjamb surface
26. Dead bolt door latch mount
28. Spring door latch mount
30. Dead bolt door latch
32. Spring door latch
34. Doorjamb shoulder
36. Notched recoiling guided stop plate
38. Coil spring guided biasing means, leaf spring, rubber, and cylinders
40. Notched guided stop plate-retaining bolt
42. Striker plate mounting tab
44. Channel guide rails for recoiling guided stop plate
46. Mounting tab for biasing coil spring
48. Impact plate for channel guide recoiling guided stop plate
50. Biasing coil spring, leaf springs, rubber, and cylinders
52. Channel guide recoiling guided stop plate
54. Channel guide stop plate fasteners

DESCRIPTION OF THE PREFERRED EMBODIMENTS

Referring to the FIGURES, like reference numbers indicate the same elements in the different views of the invention. Note that the drawings are not to scale.

Figure 4:
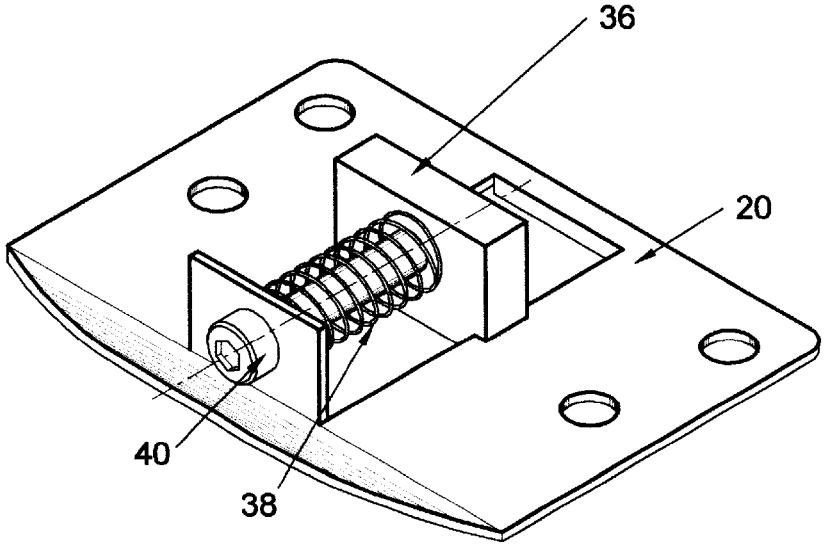
FIG. 4 is a perspective view, which illustrates the notched guided stop plate embodiment of the present invention.
Figure 5:
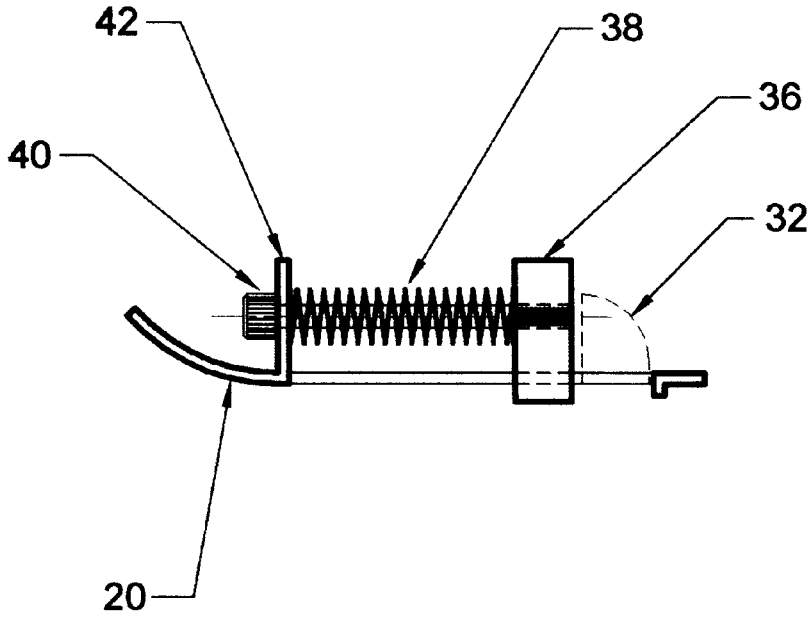
FIG. 5 shows a section view of the notched recoiling guided stop plate embodiment as cut across line 5—5 and viewed in the direction shown in the indicated arrows.
Figure 6:
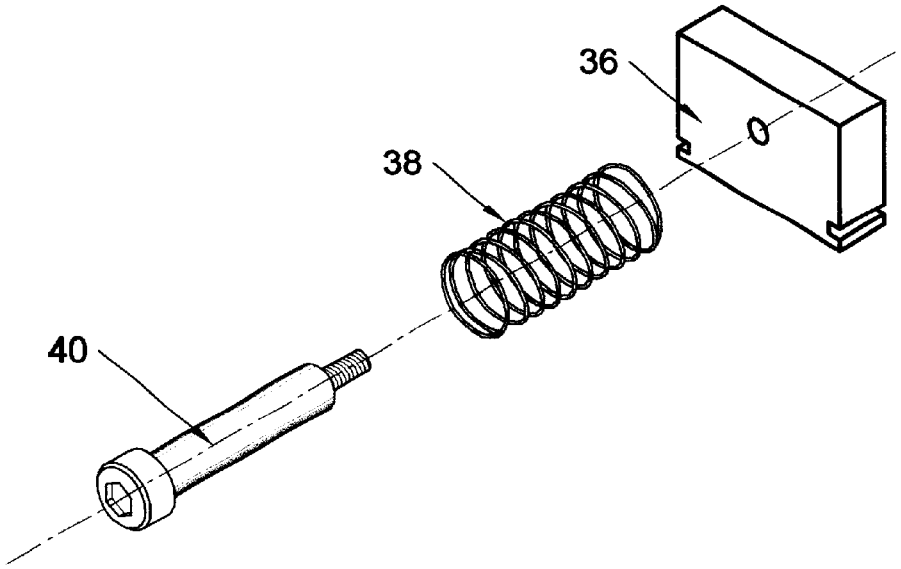
FIG. 6 shows the method of assembly of the invention shown in FIG. 4.

FIGS. 4–6 illustrate one embodiment of the present invention.

Figure 7:
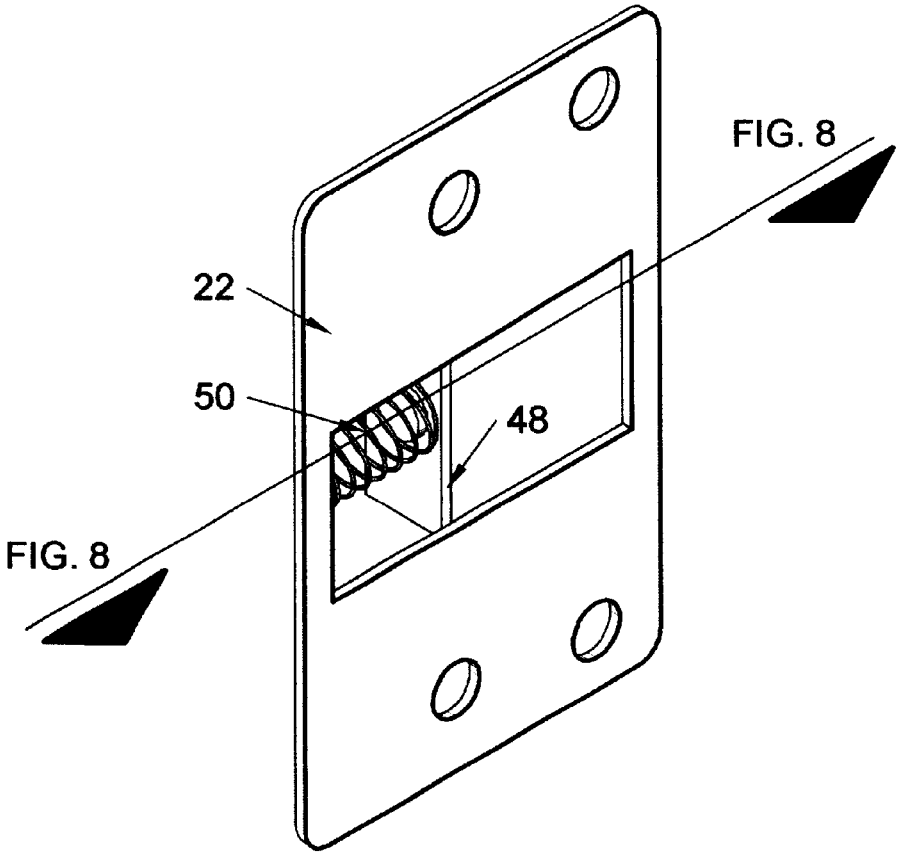
FIG. 7 shows a perspective view of the sliding channel guide embodiment of the present invention.
Figure 8:
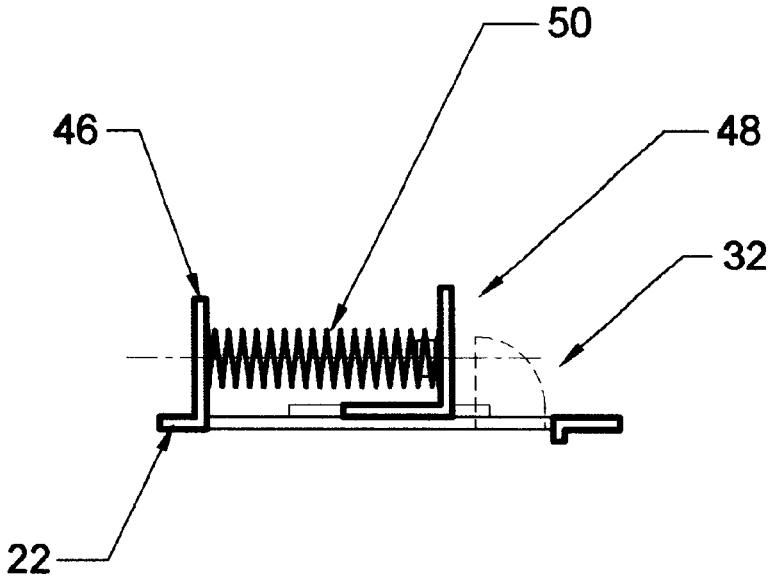
FIG. 8 shows a section view across line 8—8 of FIG. 7 in the direction indicated in the arrows shown.
Figure 9:
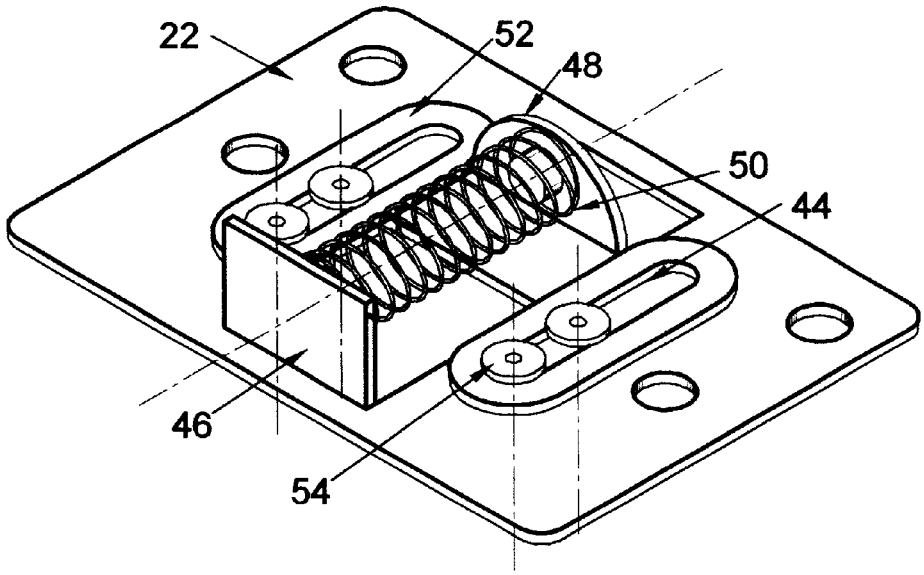
FIG. 9 shows the back side of the sliding channel guide embodiment of the present invention.
Figure 10:
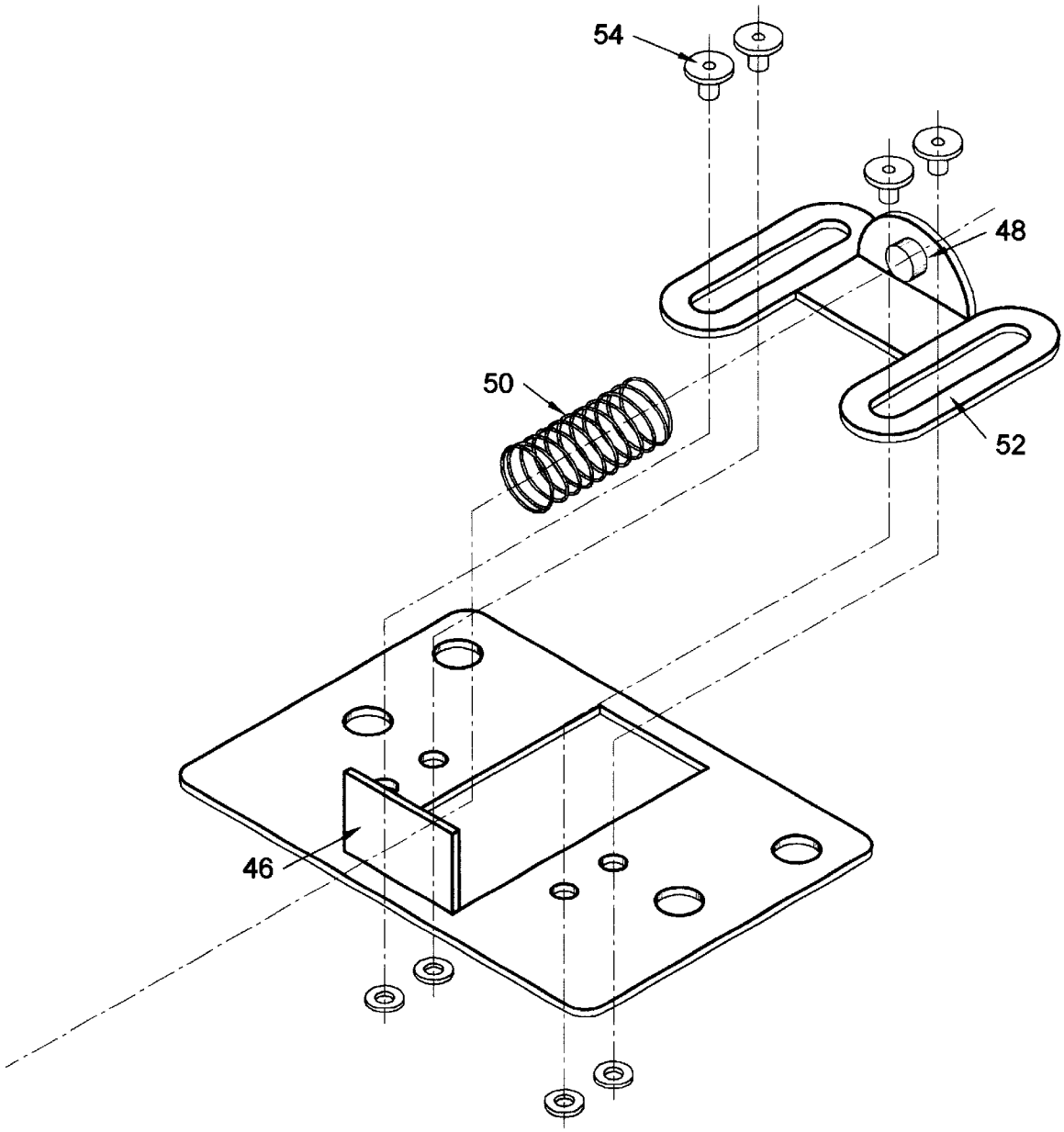
FIG. 10 shows an exploded perspective view of the sliding channel guide embodiment of the present invention.
Figure 11:
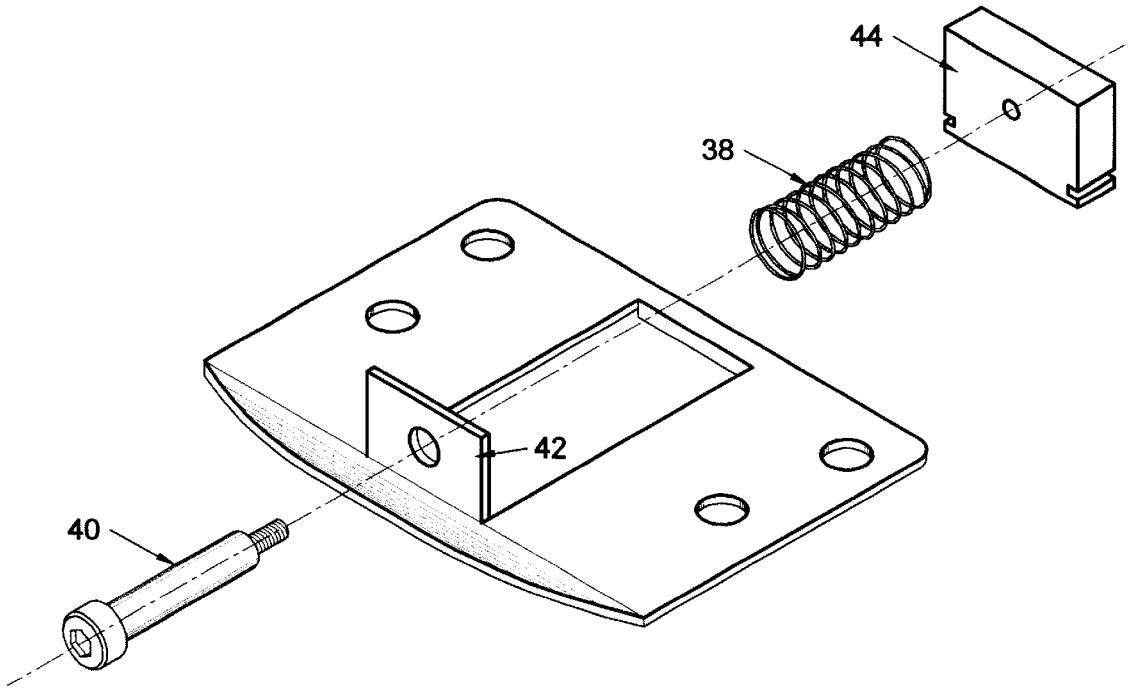
FIG. 11 shows an exploded perspective view of the notched recoiling guided stop plate embodiment of the present invention.
Figure 14A:
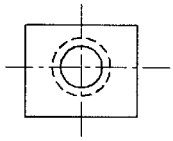
FIG. 14 illustrates the application of present invention having two mounting tabs.
Figure 14B:
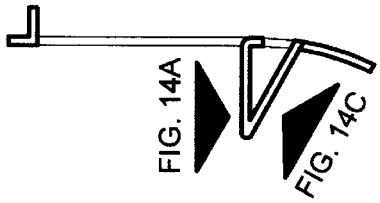
Figure 14C:
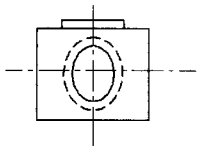
Figure 14:
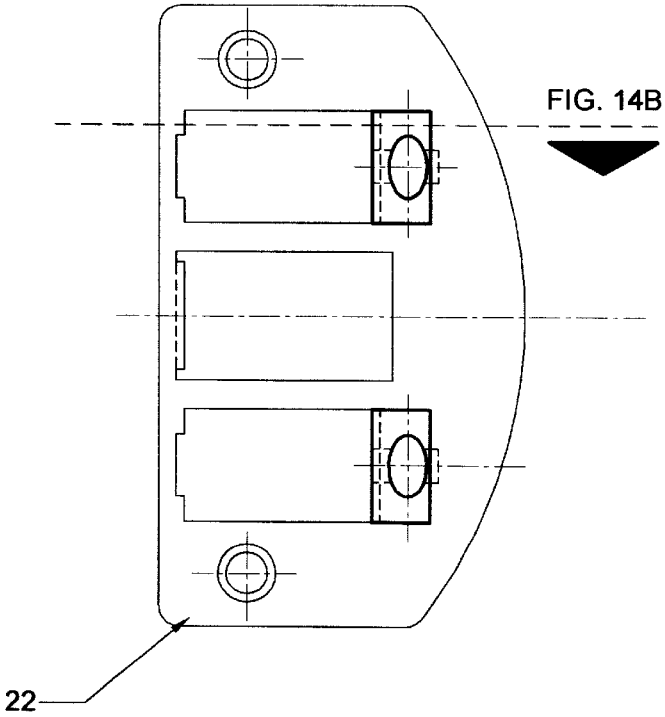
Figure 15A:
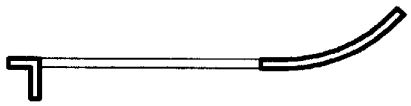
FIG. 15 shows another embodiment of (22) FIG. 18 for use with or with out back-up plate.
Figure 15:
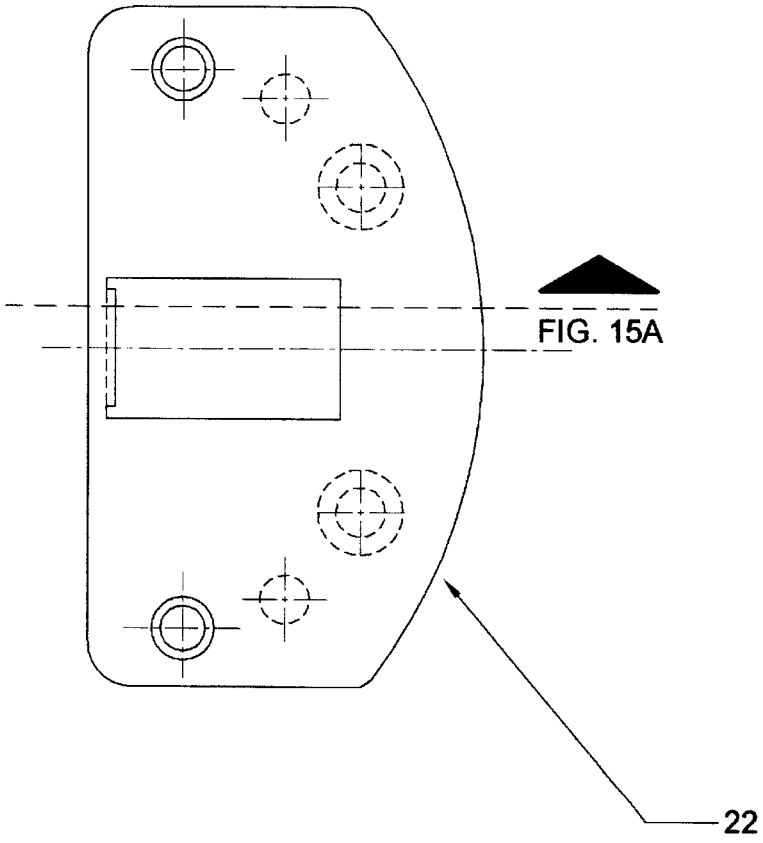
Figure 16A:
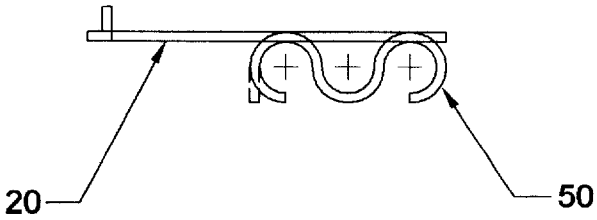
FIG. 16 illustrates the application of present invention with the use of a leaf spring biasing means where plate is made of leaf spring material.
Figure 16:
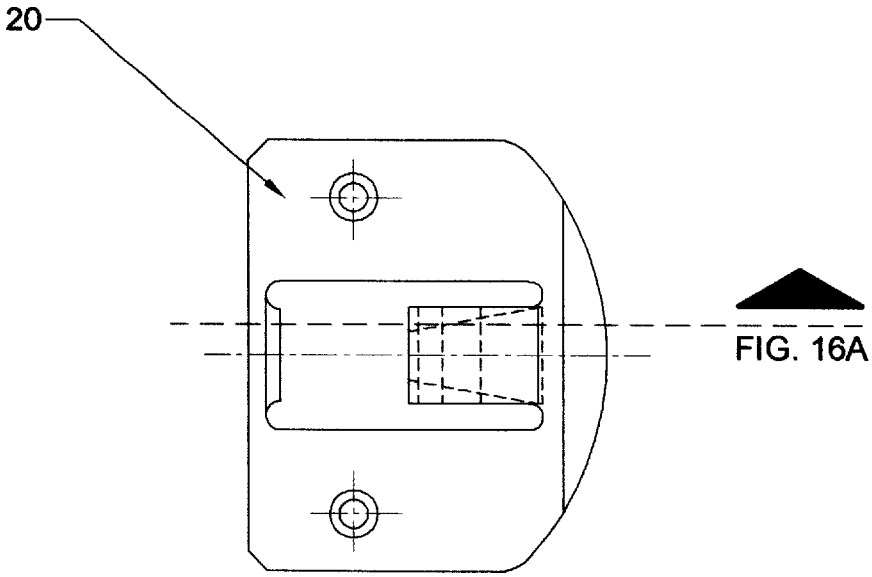
Figure 17A:
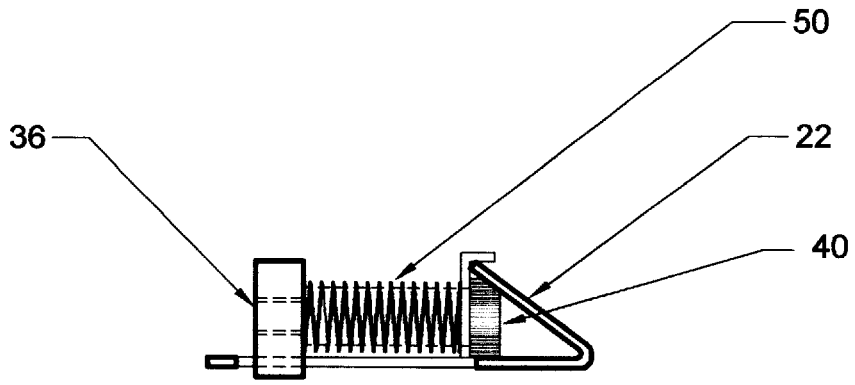
FIG. 17 illustrates the application of present invention used with two coil springs, a notched recoiling guided stop plate, and two notched guided stop plate retaining bolts.
Figure 17:
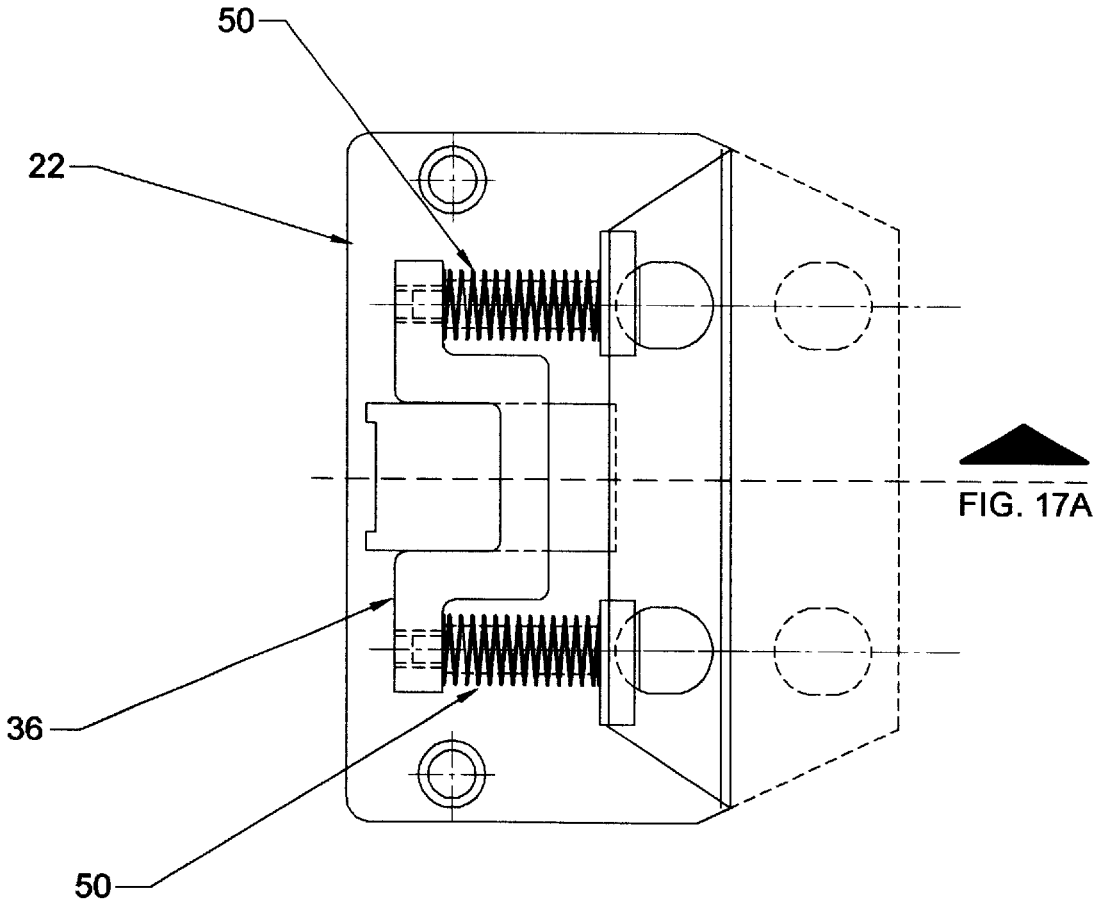
Figure 18A:
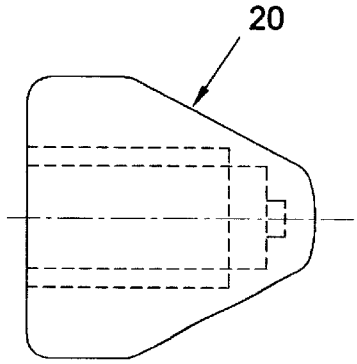
FIG. 18 shows an exploded perspective view with use of a back-up plate with one coil spring biasing means embodiment of the present invention.
Figure 18:
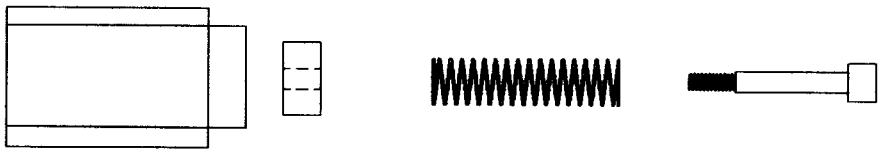

FIGS. 7–9 illustrate a second embodiment of the present invention. Referring to the figures generally and in particular to FIGS. 4–17, there are illustrated several preferred embodiments of the present invention which is an improved door security device and method for preventing or deterring "kick-in" and "pry-in" burglaries by reduction of the shock and impact transmitted to the door jamb and latch mechanism and to the striker fastening plate, which an intruder would use to force the door open.

In all embodiments, the objective of the invention is to reduce the stress and shock transmitted to the door jamb by providing a recoiling guided stop plate which moves away from the direction of the kick or prying efforts and stores the energy of the kick or other forced entry effort, thereby absorbing and reducing the pressure exerted against the securing screws and against the door jamb thus causing the door to remain in a closed position even after repeated efforts to force it open.

As seen in FIGS, 1, 4, 7, 9, 14, 15, 16, and 17 generally, in all embodiments, the structure of the present invention is comprised of an improved striker fastening plate secured to a flat door jamb surface; comprising a fastening plate (20 or 22), which has a main opening in the center of the fastening plate for insertably receiving a sliding dead bolt (30), spring latch (32), or other door latch, and a recoiling guided stop plate (36) reference page 3 of 5, FIG. 6, (52) reference page 4 of 5, FIG. 9, (36 and 52) which is constrained to move away from the direction of the force applied in an unauthorized entry attempt and returns to its' original position in said fastening plate (20 or 22), by a biasing means (38 and 50), reference page 3 of 5, FIG. 6, same as (50), reference page 4 of 5, FIG. 8, which forces it to remain in a fixed position in order to restrain the door latch (30 or 32) and thus cause the door to remain in a closed position.

In one preferred embodiment, the invention has a notched recoiling guided stop plate (36), reference page 3 of 5, FIG. 6, same as (50), reference page 4 of 5, FIG. 8, which guides upon the edges of the central opening in the striker fastening plate (20) and has a coil spring (38) which is restrained by a coil spring retaining bolt (40) that is threaded and is inserted through the central aperture of the coil spring (38) after insertion through the plate mounting tab (42) and screwed into a notched recoiling guided stop plate (36).

In a second preferred embodiment, the invention has a channel guide recoiling guided stop plate (52), reference page 4 of 5, FIG. 9, wherein the restraining means for the channel guide recoiling guided stop plate (52), reference page 4 of 5, FIG. 9, is comprised of stop plate fasteners (54) which are inserted through channel guide rails (44) at the top and bottom of the channel guide recoiling guided stop plate (52) in order to only permit travel of said guided stop plate (52) in a direction away from the applied force and returns to it's original position of the fastening plate (22), and a biasing coil spring means (50), reference page 4 of 5, FIG. 8, whereby said channel guide recoiling guided stop plate (52), reference page 4 of 5, FIG. 9, is biased into a fixed position in order to restrain a spring latch or dead bolt latch by one or more coil springs (50) and other biasing means, which are inserted between a mounting tab for biasing coil spring (46), reference page 4 of 5, FIG. 9, and an impact plate for recoiling guided stop plate (48) extending from the channel guide recoiling guided stop plate.

It should be noted that the biasing means can be different from that disclosed in the two preferred embodiments. Other examples of biasing means are leaf springs, pneumatic dampers, rubber, and other elastermeric materials, shock absorbing hydraulic dampers, and electromagnetic dampers such as solenoid resistance switches.

I claim:

1. A door jamb and striker fastening plate wherein said door jamb has a jamb shoulder and flat jamb surface, said striker fastening plate secured to said flat jamb surface and comprising:

a striker fastener plate face;

a main opening in the center of the fastening face plate for insertably receiving a sliding dead bolt moveable fastening member;

a recoiling guided stop plate constrained to move away from the direction of an applied force of an unauthorized entry attempt and return to its original position, said stop plate biased by a biasing means to remain in a fixed position in order to restrain the dead bolt moveable fastening member and thus cause the door to remain in a closed position;

a restraining means for the recoiling guided stop plate, said restraining means comprising a notch in the recoiling guided stop plate wherein the edges of the main opening in the fastening face plate operate as a guide for the notch causing the guided stop plate to travel in a direction away from the force applied in an unauthorized entry attempt and return to its original position;

wherein said biasing means comprises one or more springs threaded onto one or more stop plate retaining bolts which are screwed into the stop plate at one end thereof and attached by enlarged heads of said bolts at the other end by being inserted through one or more holes in a striker plate mounting tab perpendicular to and extending from the face plate, said striker plate holes being smaller than th e heads of said bolts.

2. The doorjamb and striker fastening plate of claim 1 wherein the biasing means is selected from the group consisting of leaf springs, pneumatic dampers, shock absorbing hydraulic dampers, electromagnetic dampers, or resilient rubber or other elastomeric material.

3. A doorjamb and striker fastening plate wherein said doorjamb has a jamb shoulder and flat jamb surface, said striker fastening plate secured to said flat jamb surface and comprising:

a striker fastener plate face;

a main opening in the center of the fastening face plate for insertably receiving a sliding dead bolt moveable fastening member;

a recoiling guided stop plate constrained to move away from the direction of an applied force of an unauthorized entry attempt and return to its original position, said stop plate biased by a biasing means to remain in a fixed position in order to restrain the dead bolt moveable fastening member and thus cause the door to remain in a closed position;

a restraining means for the guided stop plate, said restraining means comprising channel guide rails in the top and bottom of the stop plate and stop plate fasteners inserted through the guide rails, said restraining means permitting travel of the stop plate in a direction away from the applied force of an unauthorized entry attempt and return to its original position;

wherein said biasing means comprises one or more springs inserted between a mounting tab extending from the plate face and an impact plate extending from the guided stop plate.

4. The doorjamb and striker fastening plate of claim 3 wherein the biasing means is selected from the group consisting of leaf springs, pneumatic dampers, shock absorbing hydraulic dampers, electromagnetic dampers, or resilient rubber or other elastomeric material.

* * * * *